US007217109B2

(12) United States Patent
Takei

(10) Patent No.: US 7,217,109 B2
(45) Date of Patent: May 15, 2007

(54) SCROLL TYPE HYDRAULIC MACHINE

(75) Inventor: Yuji Takei, Takasaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 11/329,424

(22) Filed: Jan. 11, 2006

(65) Prior Publication Data

US 2006/0171830 A1 Aug. 3, 2006

(30) Foreign Application Priority Data

Jan. 12, 2005 (JP) ..... 2005-005215

(51) Int. Cl.
*F03C 2/00* (2006.01)
*F04C 18/00* (2006.01)

(52) U.S. Cl. ..... 418/55.3; 464/103

(58) Field of Classification Search ..... 418/55.1–55.6, 418/57; 464/102, 106, 103
See application file for complete search history.

(56) References Cited

U.S. PATENT DOCUMENTS 5,542,829 A * 8/1996 Inagaki et al. ..... 418/55.3
5,795,141 A * 8/1998 Oki et al. ..... 418/55.3
5,807,089 A * 9/1998 Tsumagari et al. ..... 418/55.3
6,331,102 B1 * 12/2001 Takeuchi et al. ..... 418/55.3

FOREIGN PATENT DOCUMENTS

EP 656477 A1 * 6/1995
JP 05018203 A * 1/1993 ..... 418/55.3
JP 08338377 A * 12/1996
JP 2001090678 4/2001
JP 2001132670 A * 5/2001

* cited by examiner

*Primary Examiner*—Theresa Trieu
(74) *Attorney, Agent, or Firm*—Baker Botts LLP

(57) ABSTRACT

Rotation interception mechanisms (10) are mounted to intervene between a drive casing (22) and a substrate (60) of a movable scroll (54), and include a binding member (11) for binding rotation of the movable scroll, a fixed side pin (14) provided with protrusion in the drive casing to get engaged with the binding member, and a swivel side pin (15) provided with protrusion in the movable scroll to get engaged with the binding member for being restrained by the binding member and swiveling around a shaft center of the fixed side pin; and load alleviation means (**54*h***) alleviates a load onto the fixed side pin and the swivel side pin caused by the torque due to the distance between the gravity center (O) and the rotation center ($O_R$) of the movable scroll and the centrifugal force.

7 Claims, 4 Drawing Sheets

SCROLL TYPE HYDRAULIC MACHINE

BACKGROUND OF THE INVENTION

1. Field of the Invention

The present invention relates to a scroll type hydraulic machine suitable as a compressor for a refrigerating circuit constituting an air conditioning system.

2. Description of the Related Art

This type of hydraulic machine, that is, a scroll type compressor is provided to a refrigerating circuit, and is disposed in an automobile, for example, inside an engine room. More specifically, a compressor is connected to an evaporator, a condenser as well as an expansion valve. These condenser and expansion valve are disposed inside the engine room while the evaporator is disposed in a vehicle interior.

This compressor comprises a scroll unit, that is, a stationary scroll as well as a movable scroll, inside a compression casing, suctions refrigerant from the evaporator side and compresses by causing the movable scroll to rotate with respect to the stationary scroll and discharge this compressed refrigerant toward the condenser side.

In order to implement swivel actions of this movable scroll, it is necessary to intercept the shaft center of the stationary scroll, that is, rotation of the movable scroll around the rotation center without preventing orbital rotation of the movable scroll around the orbital center. Therefore, as a rotation interception mechanism for intercepting this rotation, such a compressor is known that comprises a plurality of binding members for binding its rotation between a drive casing and a substrate of the movable scroll, and brings these binding members into pin connection to both of the drive casing and the movable scroll (reference should be made to, for example, Japanese Laid-Open patent (Kokai) Publication No. 2001-90678).

According to this compressor, the swivel side pin and the fixed side pin are disposed in such a position that is determined from the orbital center and the rotation center so as to alleviate the load onto the pins, in such a position in which the volume of the compressing chamber reaches 20% to 28% of the volume at the time of completion of suction of fluid.

It should be added that, there exist three reference points in the movable scroll, that is, the above-mentioned orbital center as well as rotation center and, in addition, a gravity center. Further, in general, this rotation center is employed as the center of the substrate of the movable scroll. That is because the production of the scroll unit becomes easy.

Here, there is no problem in the case where the gravity center of the movable scroll and the rotation center match. On the other hand, the gravity center and the rotation center are disposed at slight distance and therefore do not match. That is because it is necessary to make the size in the scroll unit's radius direction smaller at the time of engagement between the stationary scroll and the movable scroll.

Further, the displacement quantity being distance between the gravity center and the rotation center generates torque around the rotation center by being multiplied by the centrifugal force arising in the movable scroll. That is, a load other than the original rotation intercepting force will arise in the pin of the rotation interception mechanism. In particular, since the above-mentioned centrifugal force is proportionate to the square of the rotation speed,-an excess load arises at the time of high speed, and the decrease in durability of the rotation interception mechanism is concerned.

However, the above-mentioned prior art determines disposition of the pin from the relationship between the orbital center and the rotation center with the gravity center of the movable scroll and the rotation center match as a precondition. In other words, on a problem in the case where the above-mentioned gravity center and rotation center do not match, no particular consideration is paid and the problems on the point of load decrease in pins still remain.

SUMMARY OF THE INVENTION

The present invention has been attained in view of such a problem and an object thereof is to provide a scroll type hydraulic machine capable of alleviating the load of the pin and of achieving the improvement in the durability of a rotation interception mechanism.

In an attempt to attain the above-mentioned object, the scroll type hydraulic machine of the present invention comprises a housing having a drive casing as well as a compression casing; a drive shaft extending inside the drive casing and rotatably supported by the drive casing through a bearing; and a scroll unit housed inside the compression casing and executing a series of processes of suction, compression and discharge of refrigerant driven by the drive shaft, and this unit comprises a movable scroll that is driven by drive shaft and implements swivel movement around an orbital center being a shaft center of a stationary scroll; and rotation interception mechanisms disposed in plurality on a substrate side of the movable scroll and for intercepting the operations of the movable scroll around the rotation center without interfering swivel movements of the movable scroll, wherein the respective rotation interception mechanisms are mounted to intervene between the drive casing and the substrate of the movable scroll, and include a binding member for binding rotation of the movable scroll, a fixed side pin provided with protrusion in the drive casing to get engaged with the binding member, and a swivel side pin provided with protrusion in the movable scroll to get engaged with the binding member for being restrained by the binding member and swiveling around the shaft center of the fixed side pin, and comprises load alleviation means for alleviating loads onto the fixed side pin and the swivel side pin caused by the torque due to the distance between the gravity center and the rotation center of the movable scroll and the centrifugal force.

Therefore, according to the scroll type hydraulic machine of the present invention, it is presupposed that the gravity center of the movable scroll and the rotation center of this movable scroll do not match, and these distance and centrifugal force give rise to torque. Further, a load due to this torque acts on the fixed side pin and the swivel side pin. However, since the load alleviation means alleviates this load, the durability of the rotation interception mechanism is improved. Accordingly, it attributes to the improvement in reliability of the scroll type hydraulic machine.

In addition, preferably, the load alleviation means is a hole provided to the movable scroll in a position being axisymmetric to a straight line connecting the gravity center to the rotation center, and a swivel side pin is disposed to this hole and thereby the load caused by torque is alleviated. Moreover, the load alleviation means is a hole provided to the drive casing in a position being axisymmetric to a straight line connecting the gravity center to the orbital center, and a fixed side pin is disposed to this hole and thereby the load caused by torque is alleviated.

Thus, even if a load caused by torque arises, this load is equally distributed and acts to the fixed side pin or the swivel side pin disposed in a position being axisymmetric to the gravity center as reference. That is, in this case, without changing distance between the gravity center and the rotation center anyhow, the load arising in the pin can be reduced. In addition, consequently, the enlargement in diameter size of the pins is avoided, and the decrease in diameter size of the housing becomes attainable. Moreover, there will be no need to increase the number of units of the pin, which allows the reduction in manufacturing costs of hydraulic machines.

More preferably, the load alleviation means is a weight alleviation portion disposed in a substrate of a movable scroll at a position closer to the gravity center from the rotation center, and alleviates the load caused by torque. In addition, the load alleviation means is a weight increasing means disposed in a substrate of a movable scroll at a position on an opposite side against the gravity center side from the rotation center, and alleviates a load caused by torque.

Thus, a weight alleviation portion is provided in the substrate, and thereby the gravity center of the movable scroll is caused to approach toward the rotation center. Accordingly, in this case, the distance between the gravity center and the rotation center is minimized, so that torque is minimized, and therefore a load arising in the pin can be reduced. In addition, also in this case, the enlargement in diameter size of the pins is avoided, and there will be no need to increase the number of units of the pin.

In addition, an eccentric bush protruding from the substrate of the movable scroll toward the drive casing side and being disposed in an eccentric state from the shaft center of the drive shaft is provided with a rotatably supported boss, and the load alleviation means is a boss disposed in the movable scroll by causing the shaft center of the boss to move from the rotation center toward the gravity center side, and alleviates the load caused by torque.

Thereby, the shaft center of the boss rotationally supporting the eccentric bush is caused to move toward the gravity center side, and this boss is disposed in an eccentric state to a conventional rotation center. In other wards, in this case, the rotation center of the movable scroll is made closer to the gravity center. Accordingly, also in this case, the distance between the gravity center and the rotation center is minimized, so that torque is minimized, and therefore a load arising in the pin can be reduced. In addition, the enlargement in diameter size of the pins is avoided, and there will be no need to increase the number of units of the pin.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENTS

Figure 1:
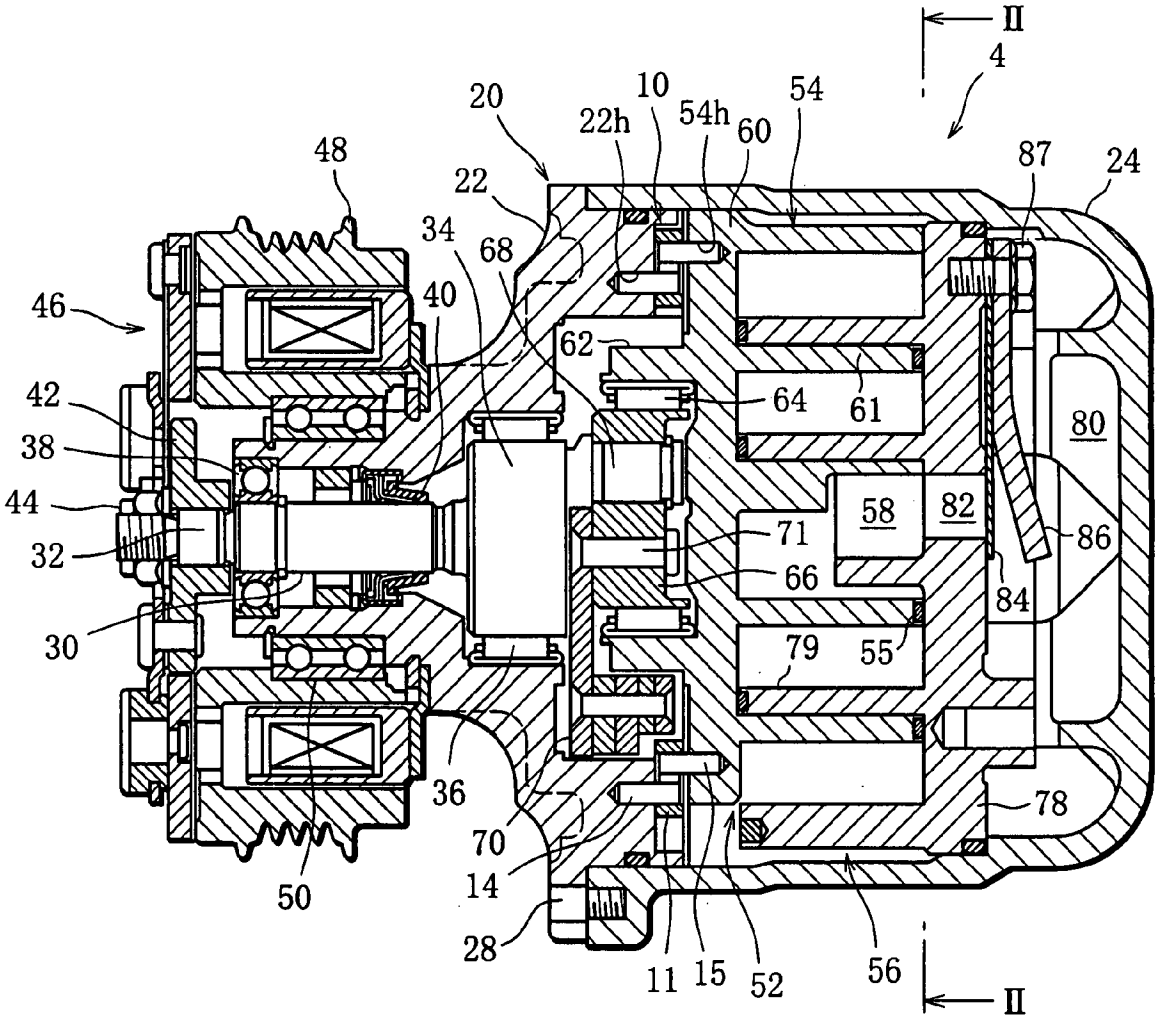
FIG. 1 is a sectional view of the configuration of the scroll type hydraulic machine in accordance with first embodiment of the present invention.

Embodiments of the present invention will be described with the drawings as follows. FIG. 1 shows a scroll type hydraulic machine in accordance with the present embodiment.

The hydraulic machine 4 is a rotational scroll type compressor provided with a housing 20. The housing 20 has a drive casing 22 as well as a compression casing 24. The casing 22 is shaped to be cylindrical with steps having diameter getting larger and larger toward the casing 24, and has two ends both being open respectively. On the other hand, the casing 24 is shaped like a cup opening toward the end with the larger diameter of the casing 22, and the open end is air-tightly fitted to the large diameter end of the casing 22 and connected to the casing 22 through a plurality of connection screws 28.

Inside the casing 22, a drive shaft 30 is disposed. This drive shaft 30 also has a stepped shape, and has a small-diameter shaft portion 32 on the side of one end and a large-diameter shaft portion 34 on the side of the other end. The shaft portion 32 protrudes from a small-diameter end of the casing 22 and a drive disk 42 is attached to the protruding end through a nut 44. The disk 42 is connected to a drive pulley 48 though an electromagnetic crutch 46, and this pulley 48 is rotatably supported by the casing 22 through a pulley bearing 50.

The shaft portion 34 is rotatably supported by the casing 22 through a needle bearing 36. In addition, the shaft portion 32 is also rotatably supported by the casing 22 through a ball bearing 38. Moreover, inside the casing 22, a lip seal 40 is disposed between the bearing 38 and the bearing 36, and this seal 40 is brought into relative sliding contact with the shaft 32 so as to zone the interior of the casing 22 in an air-tight state. When the crutch 46 is operated ON, the crutch 46 connects the pulley 48 and the disk 42 integrally and causes the drive shaft 30 to rotate in one direction together with the pulley 48. In contrast, when the crutch 46 is operated OFF, the crutch 46 cancels the connection between the pulley 48 and the disk 42 to terminate the transmission of power of the drive shaft 30 off the pulley 48.

Here, a scroll unit 52 is housed in the casing 24, and this unit 52 is provided with a movable scroll 54 and a stationary scroll 56. These scrolls 54 and 56 respectively have such scroll wraps 61 and 79 that are engaged with each other, and these wraps 61 and 79 cooperate each other to form a compression chamber 58 through a chip seal 55, etc. This compression chamber 58 moves toward the center of the wraps 61 and 79 from the outer circumference side in the radius direction with rotary movement of the scroll 54, and at that time, its volume is decreased.

In order to attain the rotary movement of the above-mentioned scroll 54, the substrate 60 of the scroll 54 has a boss 62 protruding toward the side of the casing 22, and this boss 62 is rotatably supported by an eccentric bush 66 through the bearing 64. This bush 66 is supported by the crank pin 68, and this pin 68 protrudes eccentrically from the shaft portion 34. Therefore, with rotation of the drive shaft 30, the scroll 54 will implement swivel movement through the pin 68 and the bush 66. In addition, a counter weight 70 is mounted between the bush 66 and the shaft portion 34 through a connection pin 71 and this weight 70 is configured by laminating a plurality of large and small circular plates and will become a balance weight for the swivel movement of the scroll 54.

The scroll 56 is fixed inside the casing 24, and the substrate 78 partitions the interior of the casing 24 into the compression chamber 58 and a discharge chamber 80. A discharge hole 82 communicated to the compression chamber 58 is formed at the center of the substrate 78, and this discharge hole 82 is opened and closed with a lead valve 84. This lead valve 84 together with its valve guard 86 is mounted to the exterior plane of the substrate 78 through a bolt 87. Here, while not shown diagrammatically, in the peripheral wall of the casing 24, an intake port and a discharge port are formed which are brought in communication with the compression chamber 58 and the discharge port 80 respectively. The intake port is connected to the above-mentioned evaporator, and the discharge port is connected to the condenser.

With rotation of the drive shaft 30, in the above-mentioned compressor 4, the scroll 54 implements swivel movement around the shaft center of the stationary scroll 56, that is, around the orbital center $O_S$ of the movable scroll 54 through the pin 68 and the bush 66. At this occasion, the rotation of the scroll 54 is in an intercepted state by the operation of four rotation interception mechanisms 10. Consequently, the scroll 54 implements swivel movement with respect to the scroll 56 in such a state as to keep its swivel posture constantly, which swivel movement suctions the refrigerant into the compression chamber 58 through the intake port, compresses this refrigerant and discharges the compressed refrigerant into the discharge chamber 80 to execute a series of processes. Thereafter, the compressed refrigerant is supplied to the condenser through the discharge port from the discharge chamber 80.

The above-mentioned mechanism 10 is provided with a binding member 11 mounted between the large diameter end of the casing 22 and the substrate 60 of the scroll 54. This member 11 is formed to have the shape of an approximately ellipse and is brought into pin coupling to the casing 22 and the scroll 54. Specifically, the movable scroll 54 is provided with four pin fitting holes (load alleviation means) **54*h* at an equal interval, and the casing 22 is also provided with four pin fitting holes (load alleviation means) 22*h* at an equal interval. Further, the swivel side pin 15 and the fixed side pin 14 are disposed in the longitudinal direction of the member 11 at a distance, are respectively engaged to the above-mentioned fitting holes 54*h* and the fitting holes 22*h*, and are disposed in the scroll 54 and the casing 22** so as to protrude.

Figure 2:
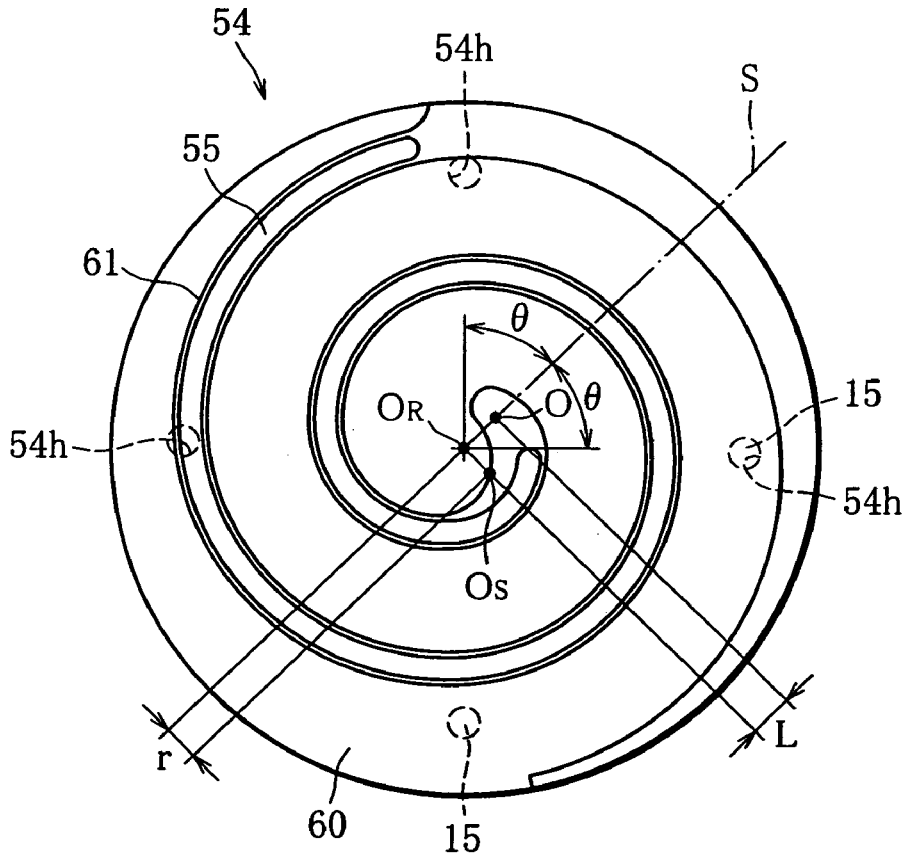
FIG. 2 is a front view of a movable scroll along a II—II line in FIG. 1.

Further in detail, as shown in FIG. 2, the scroll 54 is arranged to have the center of the substrate 60 being the rotation center $O_R$, and the distance between this rotation center $O_R$ and the above-mentioned orbital center $O_S$ is taken as the swivel radius r of the swivel side pin 15 with respect to the fixed side pin 14. In contrast, the gravity center O of the scroll 54 is positioned corresponding to the vicinity of the tip of the wrap 61, and does not match the rotation center $O_R$, and distance (displacement amount) L is present between these gravity center O and the rotation center $O_R$.

Four fitting holes **54*h* in the present embodiment do not take the straight line connecting the rotation center $O_R$ to the orbital center $O_S$ as a reference in the respective swivel positions due to orbital rotation of the scroll 54, but take a straight line S connecting the gravity center O to the rotation center $O_R$ as a reference, to which straight line S the four fitting holes 54*h* are disposed in positions being axisymmetric, and they are respectively engaged with the swivel side pin 15. In other words, the fitting holes 54*h* are, as shown in the drawings, disposed in such a position in which an angle θ made by the straight line S passing the gravity center O and the rotation center $O_R$ and a straight line connecting the center of respective fitting holes 54*h* to the rotation center $O_R$ gives 45° in the present embodiment, and the respective fitting holes 54*h*** are disposed in opposition to the rotation center $O_R$.

On the other hand, the four fitting holes **22*h* of the present embodiment take the straight line connecting the gravity center O to the orbital center $O_S$ as a reference in respective swivel positions due to orbital rotation of the scroll 54 as a reference, are disposed in positions being axisymmetric to the straight line, and are respectively engaged with the fixed side pin 14. Specifically, the fitting holes 22*h*, while not shown in FIG. 2, are always disposed in such a position in which the angle made by respective straight lines connecting the centers of the respective fitting holes 22*h* and the orbital center $O_S$ gives 90° in the present embodiment, and the respective fitting holes 22*h*** are disposed in opposition to the orbital center $O_S$.

Thus, the positional relationship between the swivel side pin 15 engaged with one binding member 11 and the fixed side pin 14 corresponds with the positional relationship between the rotation center $O_R$ and the orbital center $O_S$. Further, the dispositions of the fitting holes **54*h* and the fitting holes 22*h* engaged to these swivel side pin 15 and fixed side pin 14 alleviates load $F_P$ to the swivel side pin 15 and the fixed side pin 14** caused by torque M around the rotation center $O_R$ determined by multiplication of distance L by centrifugal force $F_C$.

Figure 3:
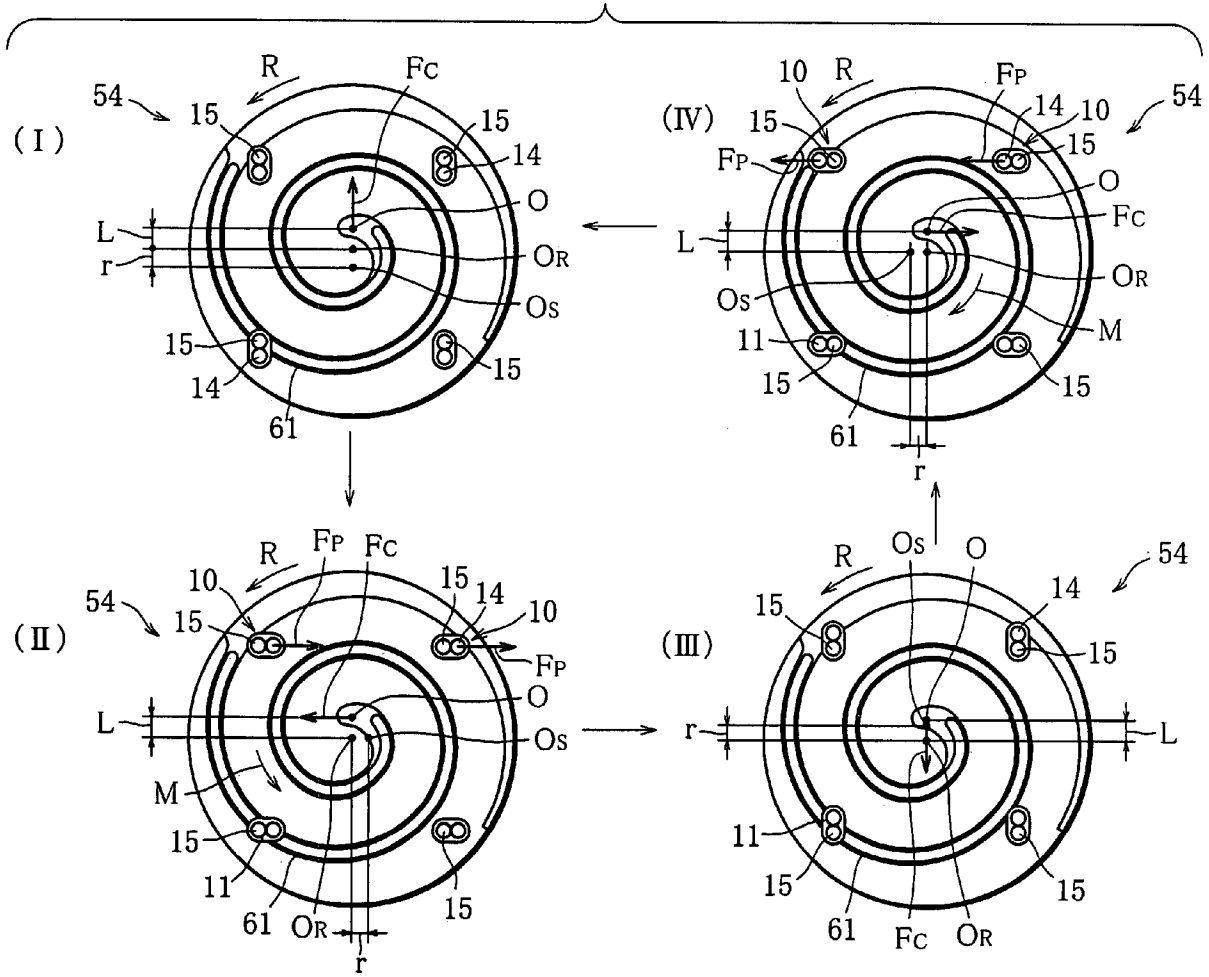
FIG. 3 is an explanatory diagram of a load onto a rotation interception mechanism in FIG. 1.

Further details will be shown in FIG. 3. Here, in this drawing, for convenience in description, four rotation interception mechanisms 10 are disposed in the front side of the movable scroll 54.

When the scroll 54 implements orbital rotation in the rotary direction R around the orbital center $O_S$ of the scroll 56, the swivel side pin 15 swivels around the fixed side pin 14 while being restrained by the member 11. At first, in a state (I) where the gravity center O, the rotation center $O_R$ and the orbital center $O_S$ aligns in this order from the above, the centrifugal force $F_C$ arises upward at the gravity center O, and this direction corresponds with the direction of a straight line connecting the gravity center O to the rotation center $O_R$, so that no torque M due to the above-mentioned centrifugal force $F_C$ arises.

Next, in a state (II) where the swivel side pin 15 swivels around the fixed side pin 14 by 90° from the above-mentioned state (I), the centrifugal force $F_C$ arises leftward, and this direction is perpendicular to the direction of the straight line connecting the gravity center O to the rotation center $O_R$. Therefore, the torque M by the above-mentioned centrifugal force $F_C$ will be maximized as shown in the drawing, and the load onto the fixed side pin 14 and the swivel side pine 15 will become the largest. However, as described above, any of the fitting holes **54*b* and the fitting holes 22*h* of the present embodiment is disposed uniformly with the gravity center O as a reference, and the load $F_P$ accompanied by this torque M will be, as shown in the drawing, distributed uniformly to the two rotation interception mechanisms 10, 10** positioned on the side of the gravity center O from the rotation center $O_R$ in a more alleviated state where no gravity center O is taken into consideration than in a conventional case.

In addition, in a state (III) where the swivel side pin 15 further swivels around the fixed side pin 14 by 90°, the centrifugal force $F_C$ arises downward, and this direction corresponds with the direction of the straight line connecting the gravity center O and the rotation center $O_R$, so that no torque M due to the above-mentioned centrifugal force $F_C$ arises.

On the other hand, in a state (IV) where the swivel side pin 15 further swivels around the fixed side pin 14 by 90°, the centrifugal force $F_C$ arises rightward, and this direction is perpendicular to the direction of the straight line connecting the gravity center O to the rotation center $O_R$. Accordingly, as shown in the drawing, the torque M due to the above-mentioned centrifugal force $F_C$ will be maximized again, and the load onto the fixed side pin 14 and the swivel side pin 15 will become the largest. However, also in this case, the load $F_P$ accompanied by this torque M is, as shown in the drawing, is alleviated more than in conventional cases, and distributed uniformly to the two rotation interception mechanisms 10, 10 positioned closer to the side of the gravity center O from the rotation center $O_R$.

Thus, in the present embodiment, attention has been focused on the point that the gravity center O of a movable scroll 54 does not correspond with the rotation center $O_R$. The relationship between distance L between them and the centrifugal force $F_C$ gives rise to torque M, and a load accompanied by this torque M acts on a fixed side pin 14 and a swivel side pin 15. However, fitting holes 54*h* are disposed in positions axisymmetric to a straight line S connecting the gravity center O to the rotation center $O_R$ and, therefore, a load $F_P$ is distributed uniformly to the fixed side pin 14 and the swivel side pin 15 of the two rotation interception mechanisms 10, 10 in an alleviated state so as to avoid the concentration of a large load accompanied by the torque M onto the rotation interception mechanisms. Consequently, breakage in the fixed side pin 14 and the swivel side pin 15 is avoided at the time of high-speed rotation in particular and the durability of the rotation interception mechanisms is improved to attribute to the improvement in reliability of the compressor.

In addition, the enlargement in diameter size of the fixed side pin 14 and the swivel side pin 15 is avoided, and moreover the size in the radius direction of the scroll unit 52 becomes smaller at the time of engagement between the scroll 56 and the scroll 54, so that the decrease in size of the casing 24 becomes attainable. Moreover, since there will be no need to increase the number of units of the fixed side pin 14 and the swivel side pin 15, the reduction in manufacturing costs of the compressors can be achieved. Further, the rotation center $O_R$ is taken as the center of the substrate 60, which also attributes to the reduction in manufacturing costs of the unit 52.

It should be added that, in the above-mentioned embodiment, without any changes in distance L between the gravity center O and the rotation center $O_R$, the reduction in loads arising in the fixed side pin 14 and the swivel side pin 15 has been achieved. However, the loads which arise in the respective pins may be reduced by trying to minimize this distance.

Figure 4:
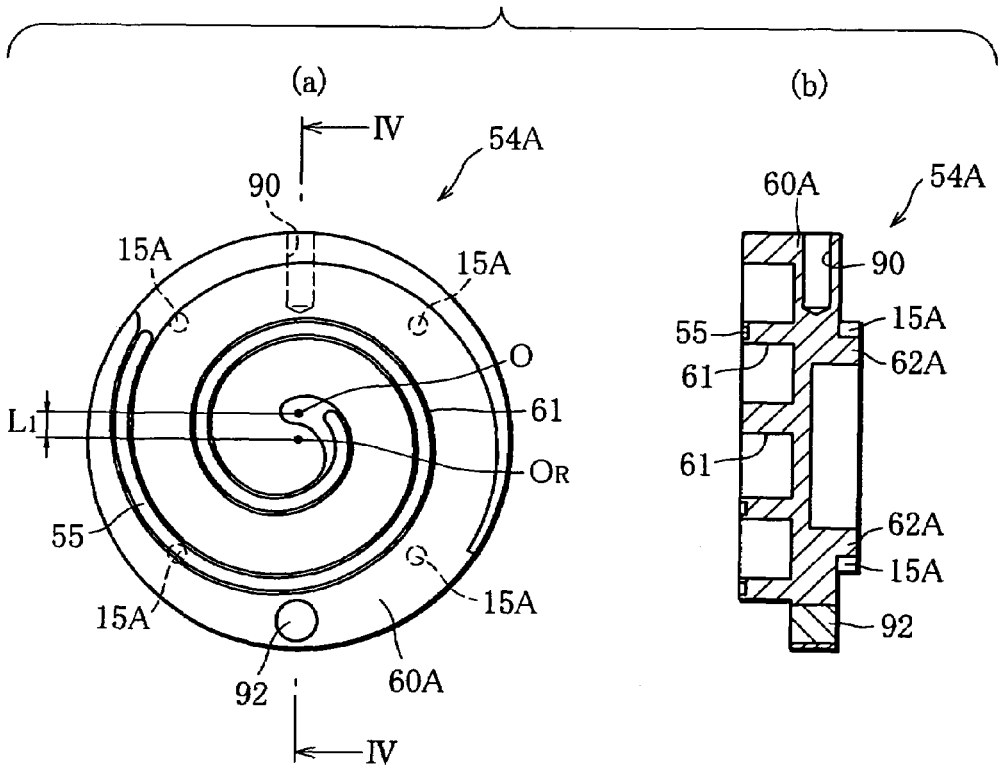
FIG. 4(*a*) is a front view of the movable scroll in second embodiment and FIG. 4(*b*) is a sectional view along a IV—IV line viewed from the direction of arrows.

Specifically, as shown in FIG. 4, the substrate 60A of the movable scroll 54A is provided with cylindrical concave portion (weight alleviation portion) 90 as load alleviation means in a position of the side of the gravity center O from the rotation center $O_R$ on a line connecting the gravity center O positioned in the vicinity of the wrap 61 and the rotation center $O_R$ being the center of the substrate 60A. In this case, the gravity center O is caused to get closer toward the rotation center $O_R$ being the shaft center of the boss 62A as well, so that the displacement amount between the gravity center O and the rotation center $O_R$ will become shorter to distance $L_1$ than in conventional cases, and the above-mentioned torque will become the minimum regardless of the position of the swivel side pin 15A. Consequently, loads which arise in the respective pins can be reduced. In addition, the enlargement in diameter size of the respective pins is avoided, and the number of units thereof does not need to be increased.

Moreover, as in the above-mentioned drawing, the substrate 60A may be provided with a cylindrical weight (weight increasing portion) 92 as load alleviation means in a position on the side in opposition to the side of the gravity center O from the rotation center $O_R$ on a line connecting the gravity center O to the rotation center $O_R$. This weight 92 is larger in specific gravity than the material of the scroll 54A, and also in this case, the gravity center O will be caused to get closer toward the rotation center $O_R$, so that the displacement amount between the gravity center O and the rotation center $O_R$ will become shorter to distance $L_1$ than in conventional cases. Therefore, regardless of the position of the swivel side pin 15A, the above-mentioned torque will become the minimum. Here, as shown in the above-mentioned drawing, a weight 92 together with the concave portion 90 may be provided, or the substrate 60A may be provided with either this concave portion 90 or a weight 92.

Figure 5:
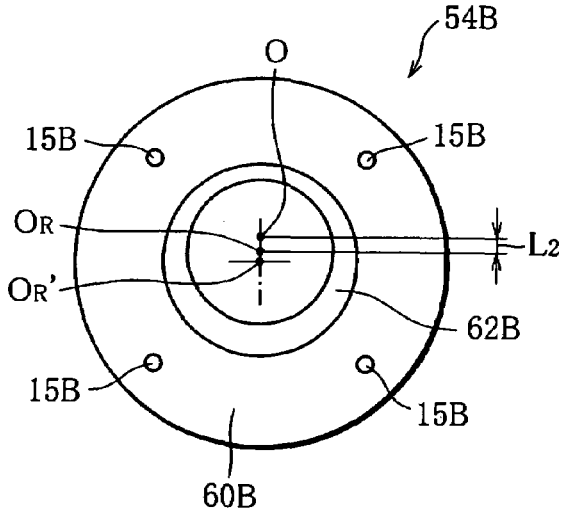
FIG. 5 is a rear view of the movable scroll in third embodiment.

On the other hand, for reduction in a load arising in the respective pins due to the minimization of the distance between the gravity center O and the rotation center $O_R$, as shown in FIG. 5, the shaft center of the boss (load alleviation means) 62B provided in the substrate 60B of the movable 54B may be moved to the side of the gravity center O from a conventional rotation center $O_R'$ for disposition. Thus, even if the boss 62B is caused to get closer to the gravity center O and made eccentric, the displacement amount between the gravity center O and the rotation center $O_R$ according to the present embodiment will get shorter to distance $L_2$ than in conventional cases, so that regardless of the position of the swivel side pin 15B, the above-mentioned torque will become the minimum, and the load arising in the respective pins can be reduced. In addition, the enlargement in diameter size of the respective pins is avoided, and there will be no need to increase the number of units thereof.

In addition, in the above-mentioned respective embodiments, four binding members are disposed at an equal distance, but the present invention will not be necessarily limited to this embodiment with a specified number of units.

The invention thus described, it will he obvious that the same may be varied in many ways. Such variations are not, to be regarded as a departure from the spirit and scope of the invention, and all such modifications as would be obvious to one skilled in the art are intended to be included within the scope of the following claims.

What is claimed is:

1. A scroll type hydraulic machine comprising:

a housing having a drive casing and a compression casing;

a drive shaft extending inside the drive casing and rotatably supported by the drive casing through a bearing; and a scroll unit housed inside the compression casing and executing a series of processes of suction, compression and discharge of refrigerant driven by the drive shaft, wherein the unit comprises a movable scroll that is driven by the drive shaft and implements swivel movement around an orbital center being a shaft center of a stationary scroll; and rotation interception mechanisms disposed in plurality on a substrate side of the movable scroll and for intercepting the operations of the movable scroll around the rotation center without interfering swivel movements of the movable scroll, wherein the respective rotation interception mechanisms are mounted to intervene between the drive casing and the substrate of the movable scroll, and include a binding member for binding rotation of the movable scroll, a fixed side pin provided with protrusion in the drive casing to get engaged with the binding member, and a swivel side pin provided with protrusion in the movable scroll to get engaged with the binding member for being restrained by the binding member and swiveling around the shaft center of the fixed side pin, and further comprises load alleviation means for alleviating loads onto the fixed side pin and the swivel side pin caused by torque due to the distance between the gravity center and the rotation center of the movable scroll and the centrifugal force.

2. The scroll type hydraulic machine according to claim 1, wherein the load alleviation means is a hole provided to the movable scroll in a position being axisymmetric to a straight line connecting the gravity center to the rotation center, and the swivel side pin is disposed to the hole and thereby a load caused by the torque is alleviated.

3. The scroll type hydraulic machine according to claim 2, wherein the load alleviation means is a hole provided to the drive casing in a position being axisymmetic to a straight line connecting the gravity center to the orbital center, and the fixed side pin is disposed to the hole and thereby the load caused by torque is alleviated.

4. The scroll type hydraulic machine according to claim 1, wherein the load alleviating means is a weight alleviation portion disposed in a substrate of the movable scroll at a position closer to the gravity center from the rotation center, and alleviates the load caused by the torque.

5. The scroll type hydraulic machine according to claim 4, wherein the load alleviating means is weight increasing means disposed in a substrate of the movable scroll at a position on an opposite side against the gravity center side from the rotation center, and alleviates a load caused by the torque.

6. The scroll type hydraulic machine according to claim 1, wherein the load alleviating means is weight increasing means disposed in a substrate of the movable scroll at a position on an opposite side against the gravity center side from the rotation center, and alleviates a load caused by the torque.

7. The scroll type hydraulic machine according to claim 1, wherein an eccentric bush protruding from the substrate of the movable scroll toward the drive casing side and being disposed in an eccentric state from the shaft center of the drive shaft is provided with a rotatably supported boss, and the load alleviation means is a boss disposed in the movable scroll by causing the shaft center of the boss to move from the rotation center toward the gravity center side, and alleviates the load caused by the torque.

* * * * *